United States Patent [19]

Holder

[11] 4,041,735

[45] Aug. 16, 1977

[54] AUXILIARY KNITTING STATION FOR HOSIERY KNITTING MACHINE

[75] Inventor: Otis W. Holder, Mount Airy, N.C.

[73] Assignee: Oakdale Knitting Company, Mount Airy, N.C.

[21] Appl. No.: 718,364

[22] Filed: Aug. 27, 1976

[51] Int. Cl.[2] ..... D04B 15/54

[52] U.S. Cl. ..... 66/133; 66/136; 66/93

[58] Field of Search ..... 66/42, 136, 133, 107, 66/93, 125 B, 108 R, 111

[56] References Cited

U.S. PATENT DOCUMENTS

| | | | |
|---|---|---|---|
| 2,231,673 | 2/1941 | Lombardi | 66/42 |
| 2,276,705 | 3/1942 | Smith, Jr. | 66/93 |
| 2,715,824 | 8/1955 | Krauss et al. | 66/93 |
| 3,122,008 | 2/1964 | Hanel et al. | 66/42 |
| 3,148,518 | 9/1964 | Peel et al. | 66/42 |
| 3,181,313 | 5/1965 | Crawford et al. | 66/136 X |
| 3,226,956 | 1/1966 | White et al. | 66/125 B |
| 3,307,377 | 3/1967 | Imboden | 66/108 A |
| 3,478,544 | 11/1969 | Homan | 66/108 R |
| 3,636,732 | 1/1972 | Townsend et al. | 66/133 |
| 3,703,819 | 11/1972 | Townsend et al. | 66/93 |
| 3,757,537 | 9/1973 | York | 66/136 X |
| 3,826,110 | 7/1974 | Holder | 66/136 X |

*Primary Examiner*—Mervin Stein
*Assistant Examiner*—Andrew M. Falik
*Attorney, Agent, or Firm*—Bell, Seltzer, Park & Gibson

[57] ABSTRACT

The auxiliary knitting station includes an auxiliary yarn feed finger in the form of a relatively thin flat, substantially vertically disposed main body portion which is movable between a lowered or active position between the latch ring and the circle of needles and a raised or inactive position above the circle of needles. The lower end portion of the auxiliary yarn feed finger includes a first yarn guide opening for feeding a first or body yarn to the needles at a level below the upper ledges of the sinkers and a pair of yarn guide openings spaced above the first yarn guide opening for selectively feeding either a terry yarn or a plating yarn to the needles at a level above the level of the body yarn.

8 Claims, 10 Drawing Figures

AUXILIARY KNITTING STATION FOR HOSIERY KNITTING MACHINE

This invention relates generally to an auxiliary knitting station for a single feed hosiery knitting machine so that the knitting machine may knit in a multiple feed manner.

For many years most hosiery knitting machines for knitting childrens' and mens' socks were of the single feed type, that is machines equipped with a single knitting station for producing a single course of knit stitches with each rotation of the needle cylinder. In recent years, some of these single feed type machines have been modified by adding one or more auxiliary knitting stations so that two or more courses are knit with each rotation of the needle cylinder so as to increase production of these machines. However, the types of auxiliary knitting stations which have been employed have required extensive modification of the knitting machine and replacement of certain parts, particularly the latch ring, to add additional yarn feeding throats. This extensive modification of the knitting machine makes the machine more complex to operate and to maintain and also increases the cost of the machine.

With the foregoing in mind, it is an object of the present invention to provide an auxiliary knitting station for a single feed hosiery knitting machine which can be easily and quickly added to the machine without requiring extensive modification of the machine and which auxiliary knittng station can be employed to either knit plain stitch loops, terry loop stitch loops, or plated yarn plain stitch loops.

In accordance with the present invention, auxiliary stitch cams are provided at a location spaced from the main knitting station and an auxiliary yarn feed finger is positioned above the auxiliary stitch cams. The auxiliary yarn feed finger is selectively movable between a lowered or active position between the latch ring and the circle of needles and a raised or inactive position above the circle of needles. The auxiliary yarn feed finger includes a relatively thin flat, substantially vertically disposed main body poriton with a lower end positioned closely adjacent the lower ledges of the sinkers when the auxiliary yarn feed finger is in the lowered or active position. A yarn guide opening is provided adjacent the lower end of the main body portion for feeding a first yarn to the needles at a level below the upper ledges of the sinkers so that plain body yarn stitch loops are formed of this first yarn. A pair of second yarn guide openings are spaced above the first yarn guide opening for feeding a second yarn to the needles at a level above the level of the upper ledges of the sinkers.

One of the pair of second yard guide openings is vertically aligned above the lower yarn guide opening while the other yarn guide opening is positioned in advance of the lower yarn guide opening so that the second yarn may be selectively fed through either of the pair of yarn guide openings. Sinker cams are positioned at the auxiliary knitting station for moving the sinkers outwardly in advance of the auxiliary yarn feed finger and for moving the sinkers inwardly after they are past the auxiliary feed finger. The sinker cam for moving the sinkers inwardly may operate to move the sinkers inwardly immediately after they pass the auxiliary yarn feed finger so that terry loops are formed over the upper level of the sinkers or the sinker cam may move the sinker s inwardly at a later point so that the upper level of the sinkers moves in above the second yarn to form plated yarn plain stitch loops.

The auxiliary feed finger includes a leading edge with a downwardly sloping portion extending to the lower end portion for serving as a latch opener as the needles pass the auxiliary yarn feed finger. The trailing edge of the auxiliary yarn feed finger includes a notch so that the upper ledges of the sinkers may be moved inwardly closely adjacent to the lower yarn guide opening to insure that the upper ledges of the sinkers move inwardly beneath the second yarn during the formation of terry loops.

Other objects and advantages will appear as the description proceeds when taken in connection with the accompanying drawings, in which FIG. 1 is a fragmentary isometric view of the latch ring and sinker cap of a conventional single feed hosiery knitting machine and illustrating the auxiliary yarn feed finger of the present invention applied thereto;

The auxiliary knitting station of the present invention may be easily and quickly applied to several different types of conventional single feed hosiery knitting machines presently in operation and is particularly adapted for application to single feed hosiery knitting machines of the type normally employed to knit mens' and children's socks. However, it is to be understood that the auxiliary knitting station of the present invention may be applied to other types of hosiery knitting machines.

Figure 4:
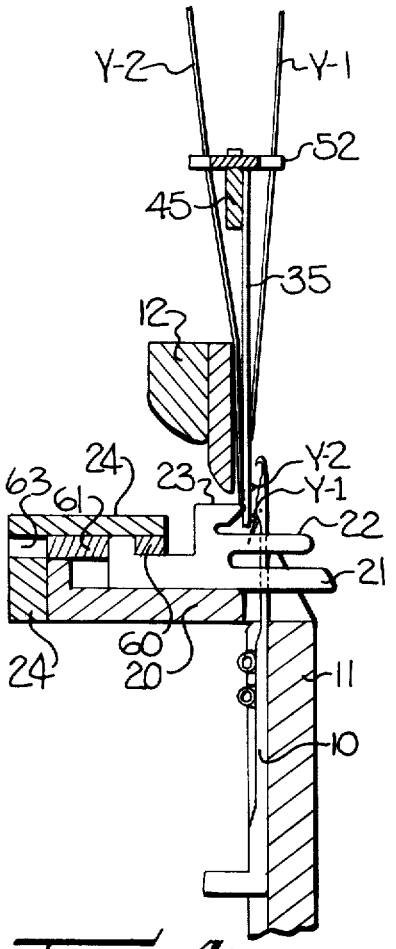
FIG. 4 is a vertical sectional view taken substantially along the line 4—4 in FIG. 3.

The conventional single feed knitting machine includes a circle of latch needles 10 supported for vertical movement in vertical slots in a needle cylinder 11 (FIG. 4) and a latch ring 12 surrounds the upper end of the circle of latch needles 10. The rear end portion of the latch ring 12 is pivotally supported as at 13 on a support post 14 so that the forward end of the latch ring 12 may be raised and lowered, in the usual manner. A main yarn feeding throat opening 15 (FIG. 1) is provided at the main knitting station and includes a plurality of yarn feed fingers 16 which are pivotally supported in the usual manner for movement into and out of active yarn feeding position at the main knitting station.

A sinker bed 20 (FIG. 4) is fixed on the needle cylinder 11 and contains radial grooves supporting sinkers 21 for radial movement therein. The sinkers each include a lower ledge 22 for forming plain stitch loops of body yarn and an upper ledge 23 for forming terry loops, in a manner to be presently described. A stationary sinker cap 24 surrounds the sinker bed 20 and supports sinker control cams for controlling the inward and outward movement of the sinkers at both the main and auxiliary knitting stations.

Figure 3:
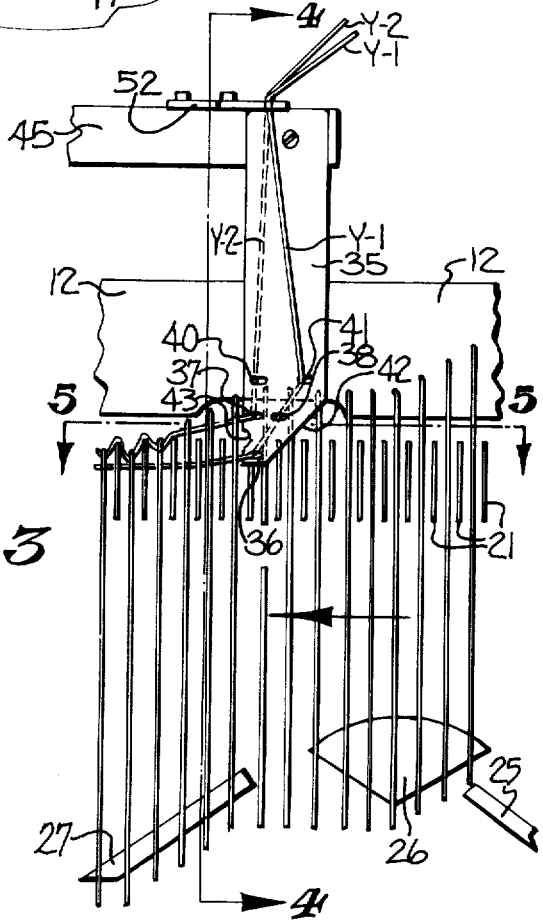
FIG. 3 is a fragmentary elevational view looking outwardly from inside of the needle cylinder and illustrating the auxiliary yarn feed finger and auxiliary stitch cams in operative position.

In accordance with the present invention, auxiliary stitch cam means, in the form of a needle raising cam, a needle leveling cam 26, and a stitch cam 27 (FIG. 3), is supported on the bed plate surrounding the needle cylinder. The needle raising cam 25 and the needle lowering cam 27 are supported for radial movement between the operative position shown in FIG. 3 and an inoperative position away from the needle cylinder 11 so that they do not engage the butts of the needles 10. As illustrated in FIG. 3, the needles 10 are raised by the raise cam 25 as they approach the auxiliary knitting station, then lowered to a level position by the leveling cam 26 as they pass the auxiliary feed finger, and are then lowered to stitch drawing level by the stitch cam 27 after they have picked up the yarns, in a manner to be presently described, from the auxiliary yarn feed finger.

Figure 6:
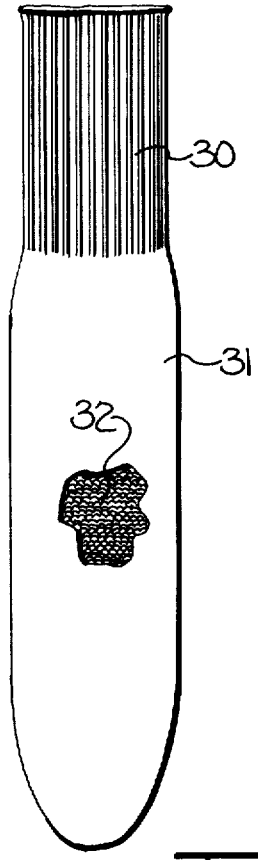
FIG. 6 is an elevational view of a "tube" type sock in flattened condition and with a portion of the upper layer being broken away to illustrate the terry loops on the inner surface thereof.

In FIGS. 2–5 the auxiliary yarn feed finger is threaded to form terry loops on the inner portion of a tube sock of the type illustrated in FIG. 6. The sock includes a mock rib cuff portion 30 and a tubular leg and foot portion 31. This type of sock is knit throughout with continuous rotation of the needle cylinder and one course is formed at the main knitting station while a second course is formed at the auxiliary knitting station with each rotation of the needle cylinder. The inner surface of the leg and foot portion 31 of the sock includes terry loops, indicated at 32.

Figure 1:
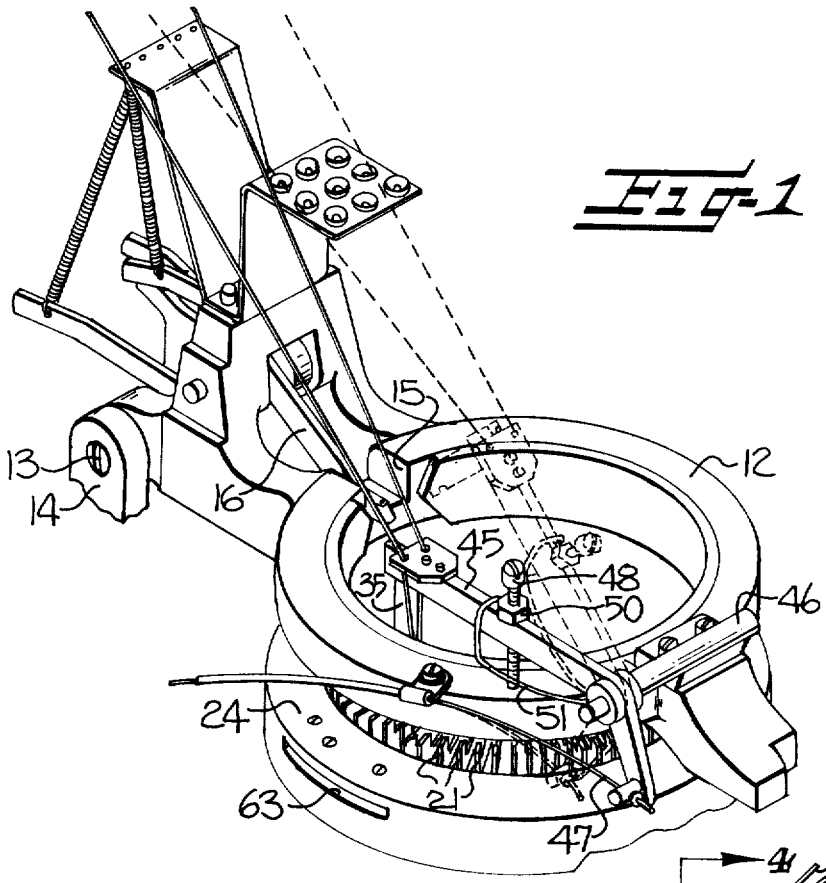

The auxiliary yarn feed finger includes a relatively thin, flat, substantially vertically disposed main body portion 35 which is selectively movable between the lowered active position between the latch ring 12 and the circle of needles 10, as shown in solid lines in FIG. 1, and an inactive or raised position above the circle of needles 10, as illustrated in dotted lines in FIG. 1. The main body portion 35 is sufficiently thin that it can move to the active position between the latch ring 12 and the circle of needles 10 (FIG. 4) without requiring any modification of the latch ring 12. The main body portion 35 includes a lower end positioned closely adjacent the lower ledges 22 of the sinkers 21 when the auxiliary yarn feed finger is in the lowered or active position shown in FIGS. 2–5.

First yarn guide means, in the form of a single yarn opening 36, is provided adjacent the lower end of the main body portion 35 for feeding a first or body yarn Y-1 to the needles 10 at a level below the upper ledges 23 of the sinkers 21. Second yarn guide means, in the form of a pair of yarn openings 37, 38 is provided above the level of the first yarn guide opening 36. The yarn guide opening 37 is substantially vertically aligned above the lower yarn guide opening 36 and the other yarn guide opening 38 is positioned in advance of the lower yarn guide opening 36. Both of the yarn guide openings 37, 38 are positioned above the level of the upper ledges 23 of the sinkers 21 for selectively feeding a second yarn to the needles 10.

As illustrated in FIGS. 2–5, the second or terry yarn Y-2 extends downwardly on the outside of the auxiliary yarn feed finger 35 and through the yarn guide opening 37 so that it is fed into the hooks of the needles 10 and at a level above the upper ledges 23 of the sinkers 21. The terry yarn Y-2 is fed to the needles 10 in substantially vertical alignment above the point at which the first or body yarn Y-1 is fed to the needles and through the opening 36.

Third yarn guide means, in the form of a pair of yarn guide openings 40, 41 (FIG. 3), is spaced above the second yarn guide means and is selectively utilized to thread the yarns Y-1 and Y-2, depending upon the type of knitting being performed at the auxiliary knitting station. As illustrated in FIG. 3, the yarn Y-1 extends downwardly on the inside of the auxiliary yarn feed finger 35, through the yarn guide opening 41 to the outside of the yarn feed finger, and then back through the lower opening 36.

As shown in FIG. 3, the leading edge of the auxiliary yarn feed finger 35 includes a downwardly sloping portion 42 extending to the lower end portion for serving as a latch opener as the needles 10 pass the auxiliary yarn feed finger. Should any of the latches of the needles extend outwardly or upwardly as they pass the sloping edge portion 42, they are cammed downwardly to the fully open position to insure that the yarns fed by the auxiliary feed finger are positioned in the hook of the needles. The trailing edge of the auxiliary yarn feed finger 35 (FIG. 3) is provided with notch 43 which is positioned at the same level as the upper ledges 23 of the sinkers 21 so that the sinkers can be moved inwardly between the upper yarn Y-2 and the lower yarn Y-1 and at a point immediately past the feeding points for these two yarns, for purposes to be presently described.

Control means is attached to the upper end portion of the main body portion 35 of the auxiliary yarn feed finger and extends above the latch ring 12 for controlling movement of the auxiliary feed finger between the active and inactive positions. The control means includes a pivoted control arm 45 extending above the latch ring 12 and supporting the feed finger 35 on its free end. The opposite end portion of the control arm 45 is pivotally supported on a pivot shaft 36 (FIG. 1) which is suitably fixed to the latch ring 12 and the opposite end of the control arm 45 is suitably connected to a control cable 37 which is operated by a control lever and cams on a pattern control drum, not shown, of the machine.

Adjustable stop means is carried by the control arm 45 and is engageable with the upper surface of the latch ring 12 for limiting and adjusting the downward movement of the control arm 45 and the auxiliary feed finger 35 when in the lowered or operative position. The adjustable stop means comprises a screw 48 threaded through the control arm 45 and provided with a lock nut 50 for maintaining the screw 48 in the adjusted position.

Resilient means, in the form of a torsion spring 51, is provided for normally urging the control arm 45 and the auxiliary yarn feed finger 35 downwardly to the operative position. One end of the torsion spring 51 extends over the control arm 45 and the other end is wound about the pivot shaft 46 and anchored to normally urge the control arm 45 downwardly to the solid line position shown in FIG. 1. A yarn guide plate 52

(FIG. 2) is fixed to and straddles the control arm 45 and a portion of the upper end of the auxiliary yarn feed finger 35. The yarn guide plate 52 is provided with yarn guide openings 53, 54 on opposite sides for directing the first yarn Y-1 downwardly on the inside of the yarn feed finger 35 and for directing the second yarn Y-2 downwardly on the outside of the auxiliary yarn feed finger 35.

Figure 2:
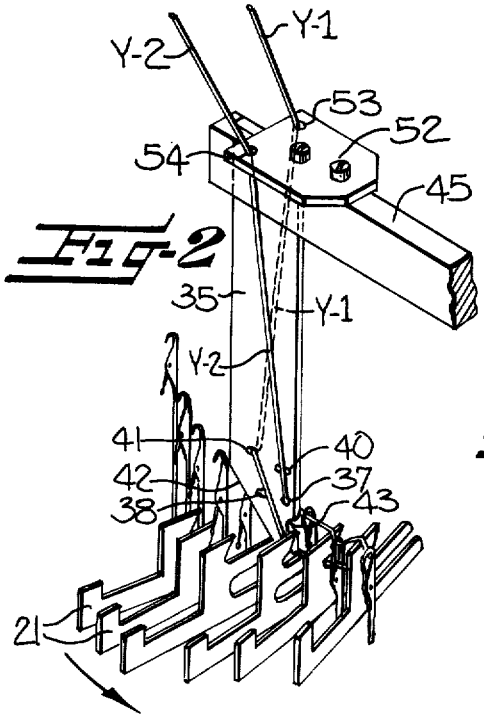
FIG. 2 is an enlarged fragmentary isometric view of the auxiliary yarn feed finger threaded for the formation of terry loop fabric and illustrating the manner in which the second yarn is fed over the upper ledges of the sinkers as they are advanced immediately after passing the auxiliary feed finger.
Figure 5:
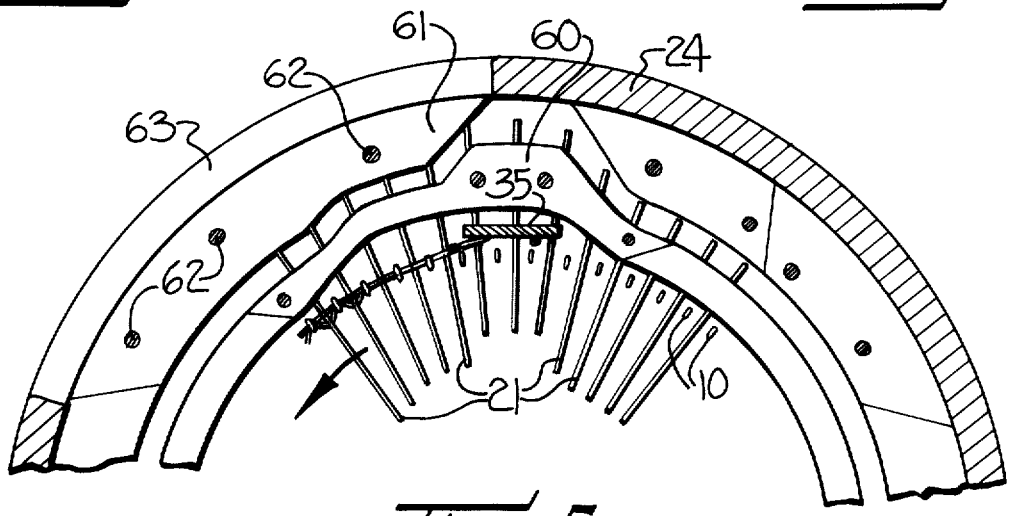
FIG. 5 is a horizontal sectional view through the sinker cap and being taken substantially along the line 5—5 in FIG. 3.

Sinker cam means is positioned at the auxiliary knitting station and is engageable with the butts of the sinkers 21 for moving the same outwardly in advance of the auxiliary yarn feed finger 35 so that the upper ledges 23 may pass the auxiliary feed finger 35 and for moving the sinkers 21 inwardly after they pass the auxiliary yarn feed finger 35. As illustrated in FIG. 5, the sinker cam means includes a sinker withdrawing cam 60 supported by the sinker cap 24 for engaging the butts of the sinkers 21 and moving them outwardly as the sinkers approach the yarn feed finger 35. A sinker cam 61 engages the outer portions of the sinker butts to immediately move the sinkers 21 back inwardly after they have passed the auxiliary feed finger 35. In fact, the sinkers 21 are moved inwardly so soon that the innermost tips of the upper ledges 23 pass through the notch 43 in the trailing edge of the yarn feed finger 35 to insure that the terry loop yarn Y-2 is deposted on top of the ledges 23, as illustrated in FIG. 2, while the lower yarn Y-1 is fed and maintained below the level of the upper ledges 23. The sinker cam 61 is supported in the sinker cap 24 by screws 62 which penetrate the sinker cam 61 and a slot 63 is provided in the sinker cap 24 so that the sinker cam 61 may be easily removed and replaced by another sinker cam, to be presently described.

METHOD OF KNITTING TERRY LOOPS

The present auxiliary knitting station is illustrated in FIGS. 2–5 as being set up for knitting terry loops with the yarn Y-2 while the yarn Y-1 forms plain body yarn stitch loops. As illustrated in FIGS. 2 and 3, the body yarn Y-1 is fed downwardly through yarn guide opening 53, on the inside of the yarn feed finger 35, through the yarn guide opening 41 and along the outside of the yarn feed finger 35, and then back through the yarn opening 36 so that it is fed to the needles slightly above the level of the lower ledges 22 of the sinkers 21. The terry yarn Y-2 is fed downwardly through yarn guide opening 54, on the outside of the yarn feed finger 35, and then through the yarn guide opening 37 so that it is fed in substantially vertical alignment above the body yarn Y-1 and above the upper ledges 23 of the sinkers 21. The sinkers 21 are moved in immediately past the yarn feed finger 35 by the sinker cam 61 (FIG. 5) so that the terry yarn Y-2 is fed above the upper ledges of the sinkers 21 to form terry loops in the sinker wales as the needles 10 are drawn down by the auxiliary stitch cam 27. The body yarn Y-1 is drawn down over the lower ledges 22 of the sinkers 21 to form plain body yarn stitches in plated relationship with the terry yarn Y-2. At the same time, terry loops and body yarn stitch loops are formed at the main knitting station in the usual manner so that the machine produces terry loop fabric in a two-feed manner, as illustrated at 32 in the leg and foot portions 31 of the sock in FIG. 6.

METHOD OF FORMING PLATED YARN STITCH LOOPS

Figure 7:
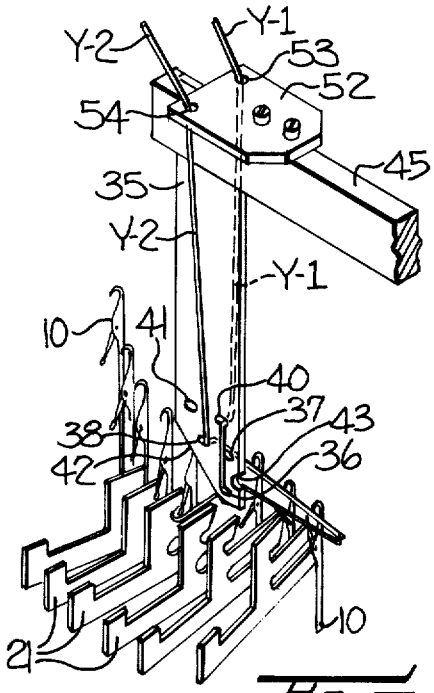
FIG. 7 is a view similar to FIG. 2 but showing the auxiliary yarn feed finger threaded to form plated yarn plain stitch loops and with the inward movement of the sinkers being delayed so that both yarns are drawn down by the needles over the lower ledge of the sinkers.
Figure 8:
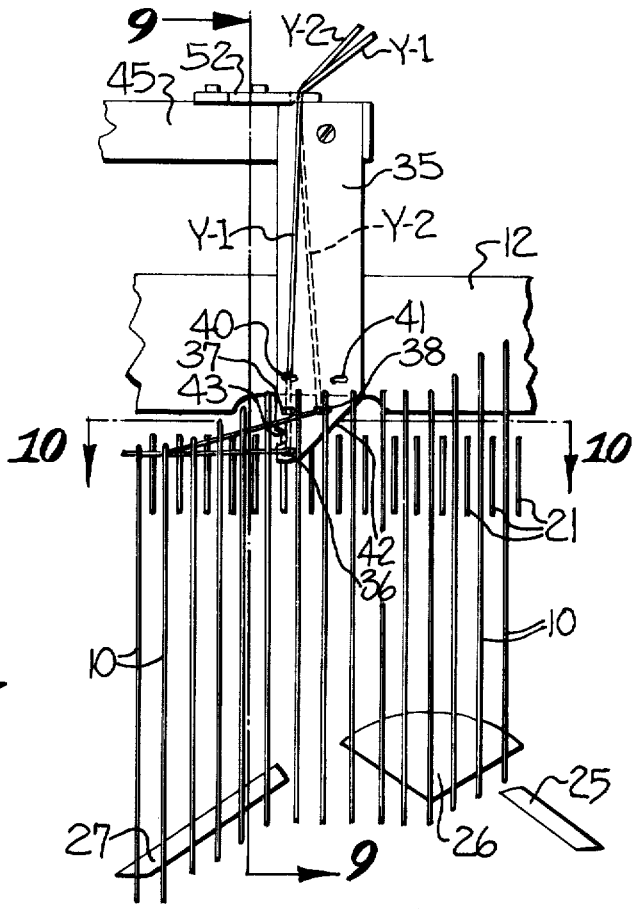
FIG. 8 is a view similar to FIG. 3 but showing the yarns being fed to the needles to form plated plain yarn stitch loops.
Figure 9:
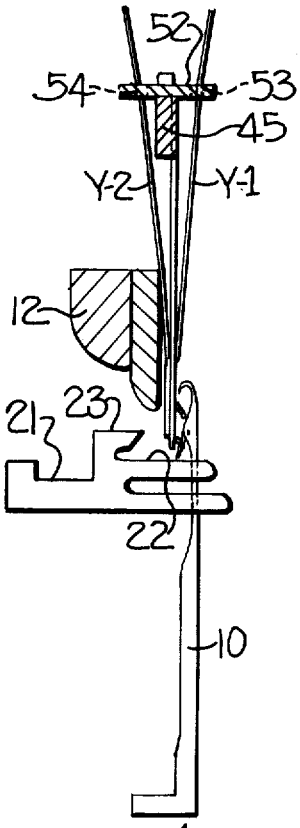
FIG. 9 is a vertical sectional view taken substantially along the line 9—9 in FIG. 8.
Figure 10:
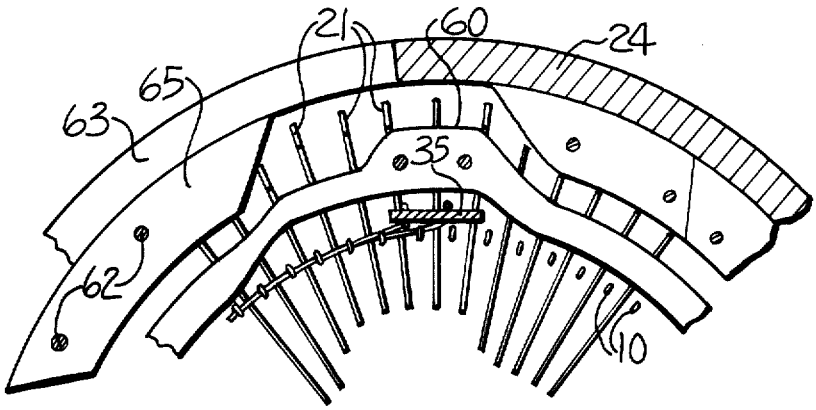
FIG. 10 is a horizontal sectional view taken substantially along the line 10—10 in FIG. 8.

The parts of the auxiliary knitting station used in forming plated yarn stitch loops (FIGS. 7–10) are the same as the parts for forming the terry loop stitch loops (FIGS. 2–5) except for the sinker cam for moving the sinkers back inwardly after they have passed the yarn feed finger 35. As illustrated in FIG. 10, a sinker cam 65 is provided with an inwardly sloping cam surface for engaging the outer portion of the butts of the sinkers 21. The cam surface of the cam 65 is spaced further around the sinker cap 24 then the cam surface of the sinker cam 61 (FIG. 5) so that the sinkers 21 are moved inwardly at a later point. Also, the yarns Y-1 and Y-2 are threaded through the yarn feed finger 35 in a slightly different manner. For forming plated yarn stitch loops, the body yarn Y-1 is fed downwardly through yarn guide opening 53, inside of the yarn feed finger 35, through the yarn guide opening 40 to the outside of the yarn feed finger, and then back through the lower yarn guide opening 36 to be fed to the needles at a point slightly above the lower ledges 22 of the sinkers 21. The plating yarn Y-2 is fed downwardly through yarn guide opening 54, outside of the yarn feed finger 35, and then through the yarn guide opening 38 so that the plating yarn Y-2 is fed to the needles at a point above the upper ledges 23 but at a point in advance of the point in which the body yarn Y-1 is fed to the needles. Since the inward movement of the sinkers 21 is delayed, by the sinker cam 65, both the yarns Y-1 and Y-2 are fed into the hooks of the needles and drawn down over the lower ledges 22, as illustrated in FIG. 7. Thus, both the body and plating yarns form plain stitch loops with the yarns in plated relationship to each other and the same type of stitch loops are also formed at the main knitting station.

Although the auxiliary knitting station of the present invention has been illustrated as being set up to form terry loops (FIGS. 2–5) and to form plated yarn stitch loops (FIGS. 7–10), it is to be understood that the present auxiliary knitting station may be used to form plain single yarn stitch loops by merely discontinuing the knitting of the yarn Y-2 and feeding only the yarn Y-1 through the lower yarn opening 36 in the auxiliary yarn feed finger 35. While a single auxiliary knitting station has been illustrated, it is to be understood that one or more additional auxiliary knitting stations may be employed at spaced points around the needle cylinder so that a course would be knit at each auxiliary knitting station. It is to be understood that the invention is not limited to the particular threading of the body, terry and plating yarns illustrated in the drawings and the yarns may be threaded through other yarn guide openings in the auxiliary yarn feed finger.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a circular hosiery knitting machine including a needle cylinder, a circle of latch needles supported for vertical movement in said needle cylinder, a latch ring surrounding the upper end of said circle of latch needles, a sinker bed supported on said needle cylinder and containing radially movable sinkers, each of said sinkers including a lower ledge for forming body yarn stitch loops and an upper ledge for forming terry loops, and a main knitting station including yarn feed fingers supported for movement into and out of yarn feeding position in said latch ring, the combination therewith of an auxiliary knitting station comprising a. auxiliary stitch cam means movable between operative and inoperative positions adjacent said needle cylinder and spaced from said main knitting station, b. an auxiliary yarn feed finger sufficiently thin to be selectively movable between a lowered or active position between said latch ring and said circle of needles and a raised or inactive position above the circle of needles, said auxiliary yarn feed finger comprising 1. a relatively flat, substantially vertically disposed main body portion including a lower end positioned below the level of said upper ledges of said sinkers and closely adjacent said lower ledges of said sinkers when said auxiliary yarn feed finger is in said active position, 2. first yarn guide means adjacent said lower end of said main body portion for feeding a first yarn to said needles at a level below said upper ledges of said sinkers, and 3. second yarn guide means spaced above said first yarn guide means for feeding a second yarn to said needles at a level above the level of said upper ledges of said sinkers, c. control means attached to the upper end portion of said main body portion of said auxiliary yarn feed finger and extending above said latch ring for controlling movement of said auxiliary yarn feed finger between said active and inactive positions, and d. sinker cam means positioned at said auxiliary knitting station and being engageable with said sinkers for moving the same outwardly in advance of said auxiliary yarn feed finger so that said upper ledges of said sinkers may pass said auxiliary yarn feed finger and for moving said sinkers inwardly immediately after they pass said auxiliary yarn feed finger.

2. In a circular hosiery knitting machine according to claim 1 wherein said relatively thin flat auxiliary yarn feed finger includes a leading edge with a downwardly sloping portion extending to said lower end portion for serving as a latch opener as said needles pass said auxiliary yarn feed finger.

3. In a circular hosiery knitting machine according to claim 1 wherein said sinker cam means (d) moves said sinkers inwardly immediately following said auxiliary yarn feed finger so that the second yarn fed through said second yarn guide means is maintained above the level of said upper ledges of said sinkers for forming terry loops over said upper ledges.

4. In a circular hosiery knitting machine according to claim 1 wherin said sinker cam means (d) delays the inward movement of said sinkers so that the second yarn fed through said second yarn guide means is fed to the needles in plating relationship with said first yarn and forms regular loops over said lower ledges.

5. In a circular hosiery knitting machine according to Claim 3 wherein said relatively thin flat auxiliary yarn feed finger includes a trailing edge with a notch therein so that the upper ledges of said sinkers may be moved inwardly closely adjacent to said first yarn guide means to insure that said upper ledges of said sinkers move inwardly beneath said second yarn during the formation of terry loops.

6. In a circular hosiery knitting machine according to Claim 1 wherein said control means (c) includes a pivoted control arm extending above said latch ring, adjustable stop means carried by said control arm and engageable with the upper surface of said latch ring for limiting downward movement of said control arm and said auxiliary yarn feed finger carried thereby, and resilient means operatively associated with said control arm for normally urging said control arm and said auxiliary yarn feed finger downwardly to the operative position, and means connected at the other end of said control arm for raising said control arm and said auxiliary yarn feed finger to the upper or inactive position above the circle of needles.

7. In a circular hosiery knitting machine according to claim 6 wherein said auxiliary yarn feed finger includes a yarn guide plate fixed to and straddling said control arm and said auxiliary yarn feed finger, said yarn guide plate having yarn guide openings in opposite sides thereof for directing the first yarn downwardly on one side of said auxiliary yarn feed finger and to said first yarn guide means and for directing the second yarn downwardly on the opposite side of said auxiliary yarn feed finger and to said second yarn guide means.

8. In a circular hosiery knitting machine according to claim 1 wherein said second yarn guide means (3) comprises a pair of horizontally aligned and spaced apart yarn guide openings extending through said auxiliary yarn feed finger, and wherein said first yarn guide means (2) comprises a single yarn guide opening extending through the lower end of said auxiliary yarn feed finger, one of said second yarn guide openings being positioned in vertical alignment above said first yarn guide opening, and the other of said second yarn guide openings being positioned in advance of said first yarn guide opening so that the second yarn may be selectively positioned in said second yarn guide openings to selectively feed the second yarn to the needles at a point in advance of or even with the point at which the first yarn is fed to the needles.

* * * * *